US005391105A

United States Patent [19]

Jones

[11] Patent Number: 5,391,105

[45] Date of Patent: Feb. 21, 1995

[54] PICTURE TOY HAVING MOVABLE LIGHT CODUCTING PEGS TO FORM PATTERNS

[75] Inventor: Lawrence T. Jones, Westlake Village, Calif.

[73] Assignee: InnoLand, Inc., Pineville, N.C.

[21] Appl. No.: 190,255

[22] Filed: Feb. 1, 1994

[51] Int. Cl.[6] ..... A63H 33/22; A63H 33/04; A63H 33/26; F21V 7/04

[52] U.S. Cl. ..... 446/219; 446/485; 446/91; 40/547; 362/32; 362/283

[58] Field of Search ..... 446/1, 219, 485, 489, 446/85, 91, 118; 40/451, 452, 547, 576, 579; 362/32, 283

[56] References Cited

U.S. PATENT DOCUMENTS

| | | | |
|---|---|---|---|
| 1,720,441 | 4/1926 | Rivkin . | |
| 1,845,530 | 9/1930 | Tarallo . | |
| 2,096,360 | 10/1937 | Heller . | |
| 2,149,363 | 2/1936 | Rivkin . | |
| 2,151,236 | 4/1937 | Schwartz et al. . | |
| 2,484,116 | 10/1949 | Papke | 446/219 X |
| 2,940,760 | 6/1960 | Brinkman, Jr. | 446/85 X |
| 3,131,496 | 5/1964 | Schrepp | 40/547 |
| 3,138,894 | 6/1964 | Reaux | 446/1 |
| 3,530,615 | 5/1968 | Meyer . | |
| 3,568,357 | 11/1968 | Lebensfeld . | |
| 3,786,500 | 1/1974 | Fiorletta et al. | 40/547 X |
| 4,115,941 | 9/1978 | Stephenson . | |
| 4,196,539 | 4/1980 | Speers . | |
| 4,541,812 | 9/1985 | Katsumata . | |
| 4,654,989 | 4/1987 | Fleming | 446/118 X |
| 5,121,926 | 6/1992 | Pfaender | 40/547 X |

*Primary Examiner*—Robert A. Hafer
*Assistant Examiner*—D. Neal Muir
*Attorney, Agent, or Firm*—Price, Gess & Ubell

[57] ABSTRACT

The picture toy includes a housing, a first opaque plate including a first array of apertures, a second opaque plate including a second array of apertures, and a plurality of light pipes. The picture toy is assembled such that each aperture of the first array is axially aligned with a corresponding aperture of the second array. Each light pipe includes a rear section and a front section which are respectively fitted into one of the apertures of the first array and its corresponding aperture of the second array. The rear section of each light pipe further includes an opaque end surface which substantially prevents light from entering the picture toy through the rear section when the light pipe is slid into a raised position. Illuminated indicia are created by selectively depressing the light pipes so that light may enter the rear section of the light pipe and propagate therethrough. The light pipes are tapered to be frictionally fitted within the apertures of the first and second arrays when the light pipes are slid into their depressed and raised positions, respectively. Additionally, the picture toy includes a member for preventing the light pipes from sliding out of the picture toy.

9 Claims, 3 Drawing Sheets

PICTURE TOY HAVING MOVABLE LIGHT CODUCTING PEGS TO FORM PATTERNS

BACKGROUND OF THE INVENTION

1. Field of the Invention

The present invention relates to a picture toy for creating illuminated indicia by selectively depressing a plurality of light pipes and, more particularly, to a picture toy including first and second arrays of apertures within which the light pipes are slidably supported and within which the light pipes are frictionally fitted into raised and depressed positions for, respectively, preventing and allowing light to propagate through the light pipes.

2. Description of Related Art

The picture toy art is generally cognizant of toys providing structure for illuminating glass or plastic pegs inserted into an array of sockets for the purpose of creating illuminated pictures. Unfortunately, the pegs typically associated with such prior art picture toys are easily lost because of their small size. Furthermore, prior art picture toys are potentially hazardous in that very young children may swallow or, even worse, choke on the pegs.

The prior art also includes a picture toy providing light conducting elements captive within a flexible opaque membrane, as shown in U.S. Pat. No. 4,541,812. Such a picture toy is complicated in its assembly, requires the use of an insertion tool to access the light conducting elements, does not provide the user with a direct tactile sensation, and is likely subject to a deterioration in the resiliency of its flexible membrane.

Other examples of prior art are shown in U.S. Pat. Nos. 1,720,441, 1,845,530, 2,096,360, 2,149,363, 2,151,236, 3,530,615, 3,568,357, 4,196,539, and 4,115,941.

Hence, the toy art is still without a easily manufactured and inexpensive picture toy which is durable as well as safe for very young children.

OBJECTS AND SUMMARY OF THE INVENTION

An object of the present invention is to provide a picture toy wherein illuminated indicia are created by selectively depressing a plurality of light pipes which are slidably supported by the picture toy.

Another object is to provide a picture toy including first and second arrays of apertures within which the light pipes are slidably supported and within which the light pipes are frictionally fitted into raised and depressed positions for, respectively, preventing and allowing light to propagate through the light pipes.

An additional object is to provide a picture toy including apparatus for preventing the plurality of light pipes from sliding out of the picture toy.

Still another object is to provide a picture toy wherein the light pipes are tapered to be frictionally fitted within the apertures of the first and second arrays when the light pipes are slid into their depressed and raised positions, respectively.

Yet another object is to provide an easily manufactured and durable picture toy embodying the above features.

The picture toy includes a housing, first and second opaque plates, and a plurality of light pipes. The first and second opaque plates respectively include a first and second array of apertures. The opaque plates and the housing are assembled such that each aperture of the first array is axially aligned with a corresponding aperture of the second array. Each light pipe includes a rear section and a front section which are respectively fitted into one of the apertures of the first array and its corresponding aperture of the second array. The rear section of each light pipe further includes an opaque end surface which substantially prevents light from entering the picture toy through the rear section when the light pipe is slid into a raised position with the opaque end surface being contiguous with the first opaque plate. The light pipes are tapered such that the rear section is frictionally fitted within the aperture of the first array supporting it when the light pipe is slid into the depressed position. Similarly, the front section is frictionally fitted within the corresponding aperture of the second array when the light pipe is slid into a raised position, thereby permitting light to enter into the picture toy and propagate through the light pipe for creating illuminated indicia. Additionally, the picture toy includes structure for preventing the light pipes from sliding out of the picture toy.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a picture toy for creating illuminated indicia by selectively depressing a plurality of light pipes.

Figure 1B:
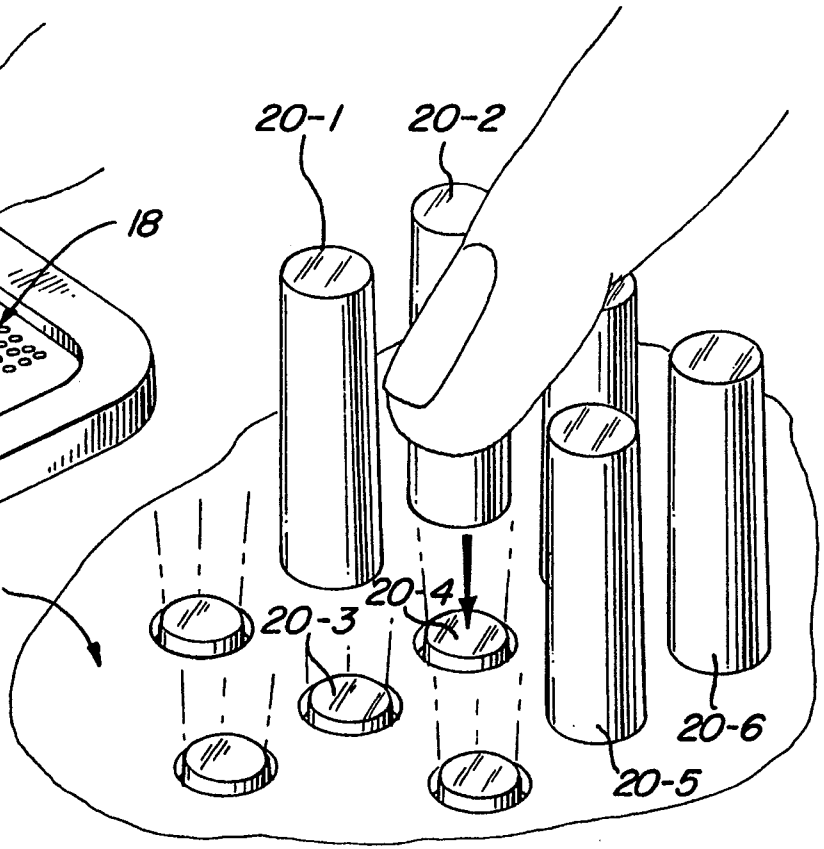
FIG. 1*a* and *b* are perspective views of a picture toy showing a player depressing a light pipe.
Figure 1A:
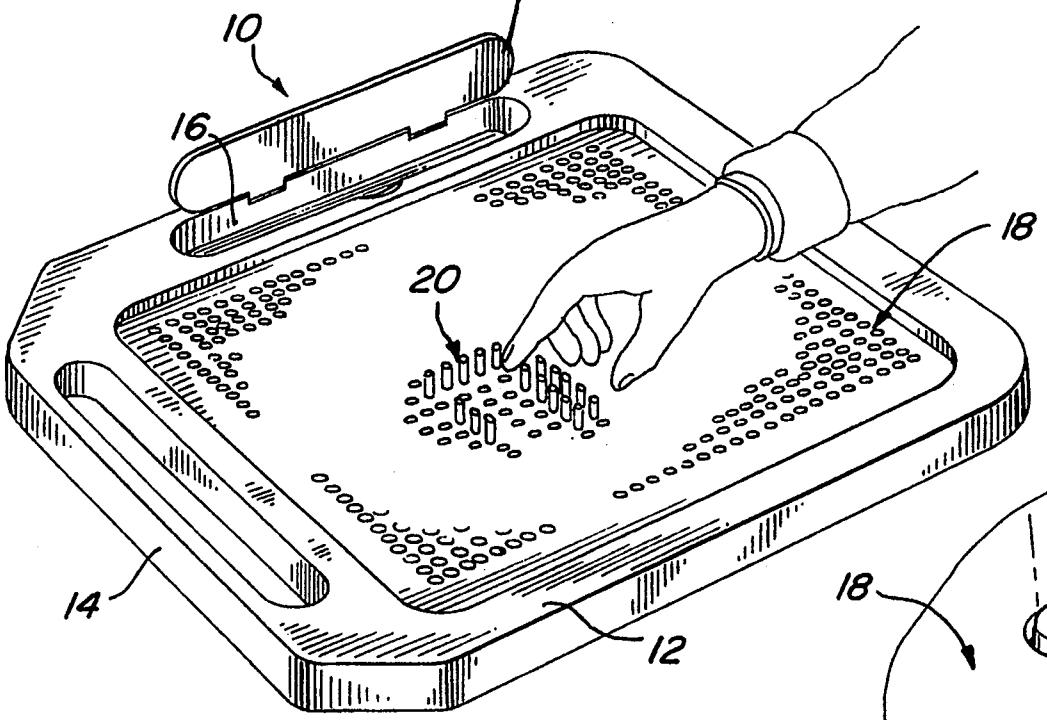

FIG. 1*a* illustrates a picture toy 10 providing an array or field of pegs which a player presses to create an illuminated picture. The field of pegs is comprised of a plurality of individual light pipes 20 which are illuminated only when appropriately slid into a depressed position. By selectively depressing the plurality of light pipes 20, a player may create illuminated indicia such as the "T" shown in FIG. 1*a*.

FIG. 1*b* is an enlarged view of the plurality of light pipes 20 shown in FIG. 1*a*. Certain light pipes 20, such as 20-1, 20-2, 20-5, and 20-6, are in a raised position extending from a front side window portion 18 of the picture toy 10 and are not illuminated, whereas other light pipes 20-3 and 20-4 have been pushed into a depressed position by a player and are accordingly illuminated. Although FIGS. 1*a* and 1*b* show a player selectively depressing the plurality of light pipes 20 by hand, the envisioned picture toy 10 further contemplates the utilization of various tools, templates, etc. for creating illuminated pictures with greater speed and/or precision.

Figure 2:
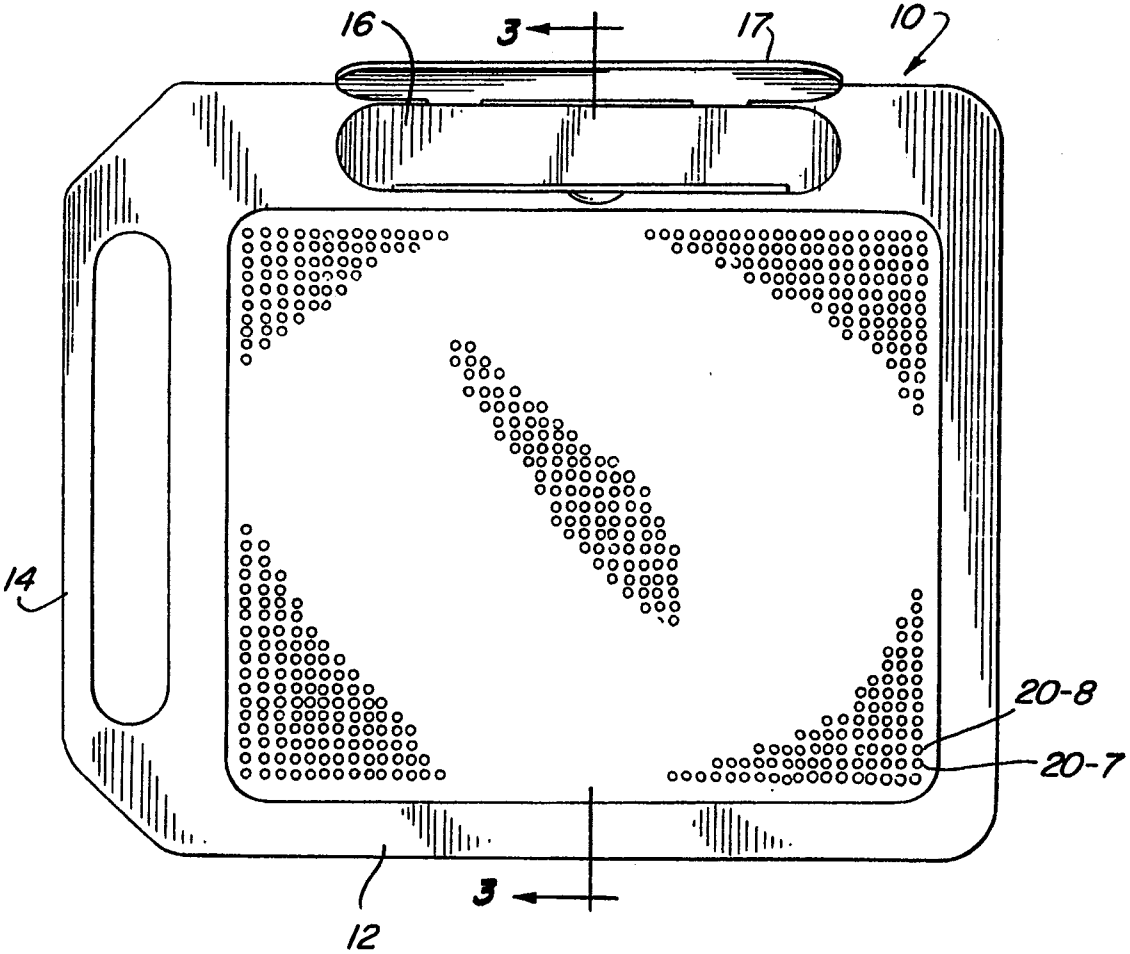
FIG. 2 is a front view of the picture toy of FIG. 1.

The picture toy 10 shown in the FIG. 2 front view is assembled into a housing 12 which defines a handle portion 14 allowing the picture toy 10 to be easily transported by a child. Additionally, the housing 12 includes a recess 16 and an attachable cover 17 which is preferably hinged to the picture toy 10. Various tools for depressing the light pipes 20 (e.g., stylus, T-bar, etc.) may be stored in the recess 16. A manufacturer of the picture toy 10 may adhere an identifying logo, operating instructions, pictures of cartoon characters, etc. to the cover 17. Preferably, the window portion 18 is centrally located and approximately forms a rectangular border around the plurality of light pipes 20. The housing 12 is preferably made from a nontoxic plastic.

Although other arrangements of the plurality of light pipes 20 are contemplated, the picture toy 10 preferably provides a two-dimensional array of light pipes which are approximately 0.1875-inch apart as measured, for example, by the distance from the center of the light pipe 20-7 to the center of the nearest adjacent light pipe 20-8. The preferred two-dimensional array of light pipes 20 comprises 1,833 light pipes 20 in a 39×47 configuration. As may be readily appreciated, the resolution provided by the picture toy 10 depends upon how many light pipes 20 are provided, how large they are, and how closely they are spaced together, and upon the overall size of the window portion 18.

In the preferred embodiment of the toy, ambient light is used to illuminate the pegs. Only a pair of parallel opaque plates 30 and 40 are attached and spaced apart, with the light pipes 20 being captured between the plates.

Figure 3:
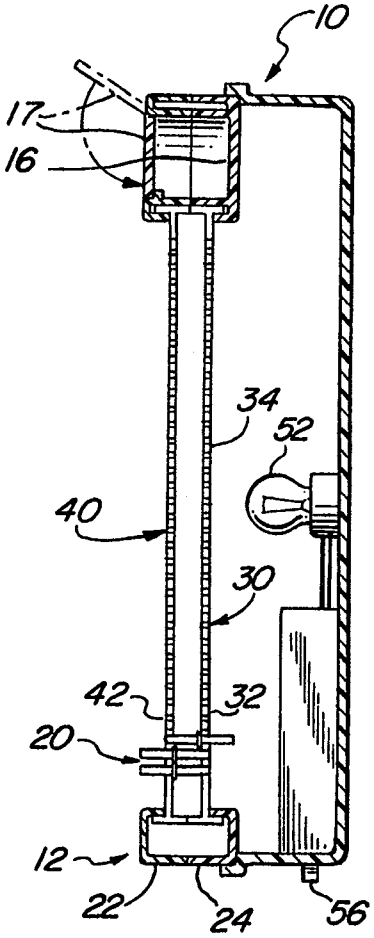
FIG. 3 is a cross-sectional side view of the picture toy of FIG. 1.

FIG. 3 is a cross-sectional side view of the picture toy 10. As is best shown in this illustration, the housing 12 comprises an upper housing portion 22 and a lower housing portion 24 which are attached together to form the housing 12. The picture toy 10 further comprises a first opaque plate 30 including a first array of apertures 32 and a second opaque plate 40 including a second array of apertures 42. The plurality of light pipes 20 slidably fit within the first and second arrays of apertures 32, 42. The first and second opaque plates 30, 40 are, in turn, bound within the housing 12 between the upper housing portion 22 and the lower housing portion 24.

The picture toy 10 can further include an optional back shell 50 which can be attached to the assembled housing 12 at the lower housing portion 24. Within the back shell 50 is a source of light 52 and its accompanying power supply 54 and switch 56. When the switch 56 is moved to its "on" position, the power supply 54 (e.g., commercially available D-size battery cells) energizes the source of light 52, thereby directing light toward a back surface 34 of the first opaque plate 30. It is further contemplated that the housing 12 may be alternatively formed to include an additional portion serving the same function as the above-described back shell 50. For example, a portal may be provided on such an alternative housing through which the source of light 52 and power supply 54 may be accessed.

As can be appreciated, the back shell 50 can be permanently fastened to the housing portion 24 as an alternative embodiment of the invention. Also, the present invention can be utilized without the light source of the back shell 50 by using ambient light and an appropriate positioning of the housing 12.

Figure 4:
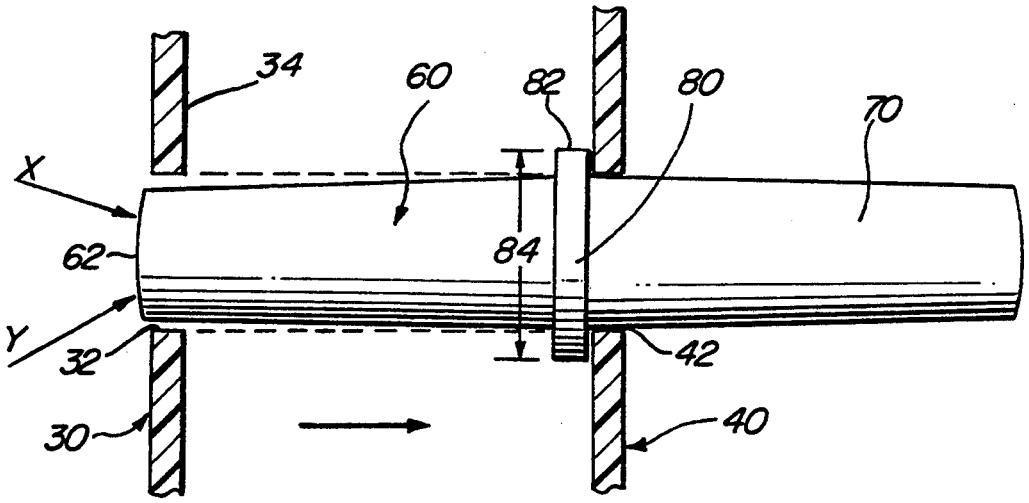
FIG. 4 is an enlarged, cross-sectional side view showing a front section of the light pipe of FIG. 1 frictionally fitted into an aperture of the second array.

FIG. 4 is an enlarged, cross-sectional side view of a light pipe 20 shown supported between the first opaque plate 30 and the second opaque plate 40. As is best illustrated in this figure, the second opaque plate 40 is positioned relative to the first opaque plate 30 and the housing 12 such that light can enter the picture toy 10 only through the apertures of the first and second arrays 32, 42, and such that each aperture of the first array 32 is axially aligned with a corresponding aperture of the second array 42.

Each light pipe 20 is supported by the first and second opaque plates 30, 40 and includes a rear section 60 which is slidably fitted into one of the apertures of the first array 32. Additionally, the preferred light pipe 20 includes a front section 70 slidably fitted into the corresponding aperture of the second array 42. The rear section 60 of each light pipe 20 includes an opaque end surface 62 which substantially prevents light (illustrated as coherent light rays X and Y) from entering the light pipe 20 through the rear section 60 when the light pipe is slid into a raised position with the opaque end surface 62 being contiguous with the first opaque plate 30. The end surface 62 may, for example, derive its opacity by being coated with opaque paint (preferably white in color), or by adhering a label (e.g., vinyl) to or hot-stamping the end of the light pipe 20.

A principal advantage of the picture toy 10 is that it additionally provides means for preventing the plurality of light pipes 20 from sliding beyond a range of positions spanning between the raised position and the depressed position. As illustrated in FIG. 4, each light pipe 20 includes a central section 80 joining the rear section 60 and the front section 70. Preferably, the means for preventing sliding comprises a ridge 82 attached to the central section 80 of the light pipe 20. The ridge 82 may be circumferentially formed around the central section 80 and should create a central section outer diameter 84 larger than the diameters of the apertures of the first and second arrays 32, 42. Although described as including a rear section 60, front section 70, control section 80, and ridge 82, each light pipe 20 is preferably formed or molded as a single piece.

The length of each light pipe 20 is selected depending upon the distance between the first opaque plate 30 and the second opaque plate 40 in view of the requirement that each light pipe 20 be supported by both the first opaque plate 30 and the second opaque plate 40. If the rear section 60 is too short, the rear section 60 will not be supported by the first opaque plate when the light pipe 20 is in the raised position, nor will the light pipe 20 be supported by the second opaque plate 40 when in the depressed position. If the rear section 60 is too long, the opaque end surface 62 will not be contiguous with the first opaque p%ate when the flight pipe 20 is in the raised position, thereby resulting in unwanted light entering into the light pipe 20 through the rear section 60 protruding from the aperture of the first array 32.

An additional advantage of the picture toy 10 is that its light pipe 20 is specifically designed to be frictionally fitted into the apertures of the first and second arrays 32, 42 when the light pipe 20 is slid into its depressed and raised positions, respectively. The rear section 60 of each light pipe 20 is characterized by a rear section diameter increasing toward the central section 80. Similarly, the front section 70 of each light pipe 20 is characterized by a front section diameter increasing toward the central section 80. This tapered configuration of the light pipe 20 results in the frictional fitting of the front section 70 within the aperture of the second array 42 when the light pipe 20 is slid into the raised position, as is best illustrated in FIG. 4.

As may be readily appreciated, the front section diameter immediately adjacent to the ridge 82 is slightly larger than the diameter of the aperture of the second array 42. When the light pipe 20 is slid into the depressed position (FIG. 6), the rear section 60 immediately adjacent to the ridge 82 is frictionally fitted within the aperture of the first array 32. Similarly, the diameter of the front section 60 near the central section 80 should be slightly larger than the diameter of the aperture of the first array 32.

In summary, the picture toy 10 eliminates the need for rubber gaskets and other similar securing mechanisms, which are vulnerable to rapid wear and degradation, by providing a simple and durable "frictionally fitting" tapered light pipe 20. A brief discussion of the light-propagating characteristics of the preferred light pipe 20 follows.

Figure 5:
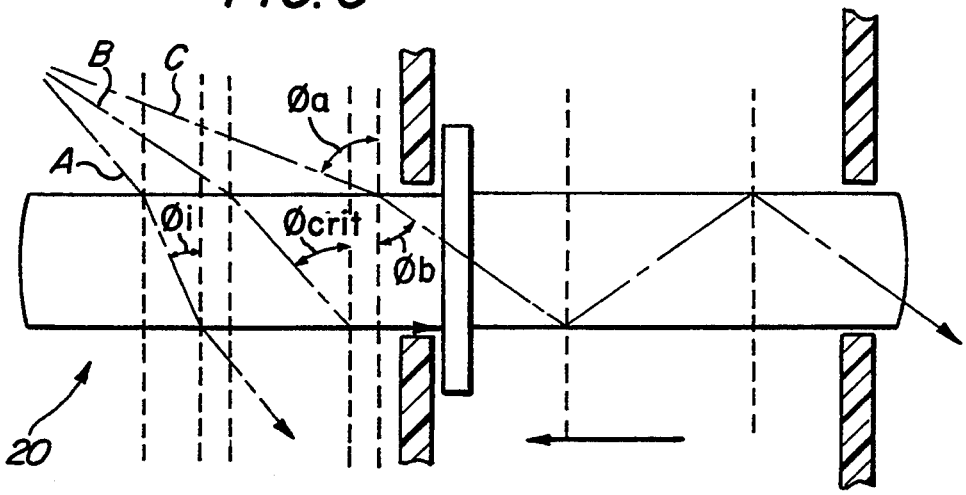
FIG. 5 is an enlarged, cross-sectional side view of a light pipe showing tile propagation of coherent light rays through a cylindrical light pipe.

FIG. 5 is an enlarged, cross-sectional side view of a light pipe 20 slid into a depressed position permitting the entry of light into and the propagation of light through the light pipe. The light pipe 20 of FIG. 5 is cylindrical in shape (i.e., illustrated without tapered rear and front sections 60, 70) for the purpose of better diagramming the general principles which govern propagation of light through the light pipe 20. The preferred light pipe 20 is made from any material with an index of refraction suitably high for light piping when surrounded by ambient air. Polystyrene and lucite are examples of materials which may be used to manufacture the light pipes 20. Additionally, color tints or pigmentations may be added as desired to the selected material before the light pipe 20 is formed.

FIG. 5 shows coherent light rays denoted as A, B, and C entering into the rear section 60 of the light pipe 20. If the material comprising the light pipe 20 is denoted as b and the surrounding air denoted as a, the passage of, for example, coherent light ray C from the surrounding air into the rear section 60 of the light pipe 20 is governed by the relationship $$n_a \sin \phi_a = n_b \sin \phi_b$$

(Snell's law) wherein $n_a$ and $n_b$ are the respective indices of refraction of air and the light pipe 20, and wherein $\phi_a$ and $\phi_b$ are the respective angles of incidence at the air and light pipe sides of the air/light pipe interface.

Since the index of refraction of the light pipe 20 ($n_b$) is greater than the index of refraction of the surrounding air ($n_a$), a critical angle of incidence exists for light rays propagating through the light pipe 20 at and above which such rays will be totally internally reflected back into the light pipe 20. In view of Snell's law, the ratio $n_b/n_a$ should be maximized to decrease the critical angle and thereby statistically increase the percentage of incident light rays which will propagate through the light pipe 20. Accordingly, light piping materials with a higher index of refraction are preferred. As may be readily appreciated, the transmittance of the material selected for light piping is an additional consideration apart from the material's index of refraction. The coherent light ray C of FIG. 5 illustrates the principal of total internal reflection upon which effective light piping is dependent.

The coherent light ray B of FIG. 5 is shown incident to the light pipe/air interface at the critical angle ($\phi_{crit}$) and, accordingly, does not pass through the light pipe 20 and into the surrounding air, but emerges just grazing the surface of the light pipe 20 at an angle of refraction of 90 degrees. Although entering the light pipe 20, coherent light ray A is not totally internally reflected because its angle of incidence ($\phi_i$) is too small. Thus, the light pipe 20 illustrated in FIG. 5 is not completely efficient because some of the light rays (such as the coherent light ray A) do not propagate through the light pipe 20, but instead pass directly through the light pipe 20.

Figure 6:
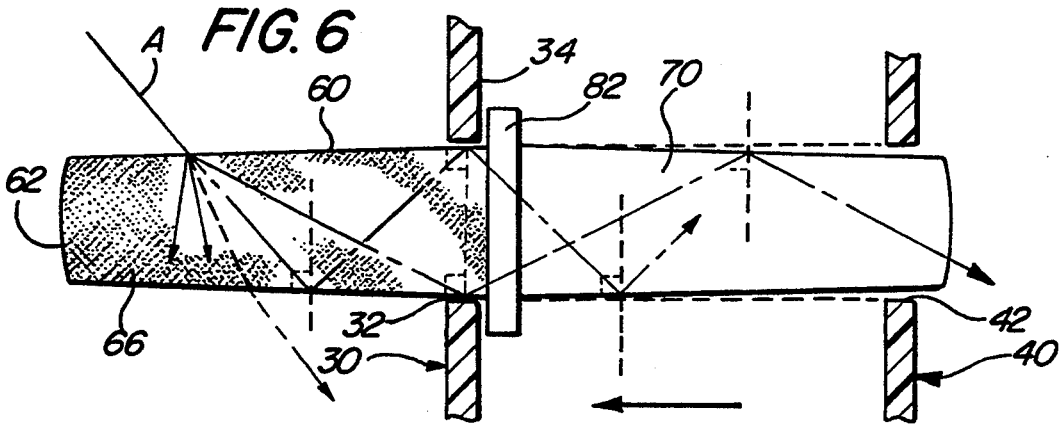
FIG. 6 is an enlarged, cross-sectional side view showing the rear section of the light pipe of FIG. 1 frictionally fitted into an aperture of the first array.

FIG. 6 is an enlarged, cross-sectional side view of the light pipe 20 slid into its depressed position with the rear section 60 frictionally fitted into the aperture of the first array 32. When the light pipe 20 is slid into this depressed position with the rear section 60 protruding from the picture toy 10 through the first aperture 32, the rear section 60 is exposed to the source of light 52 (FIG. 3). Since the source of light 52 faces the back surface 34 of the first opaque plate 30, light rays incident upon an outer surface 66 of the rear section 60 are allowed to enter the light pipe 20 when the light pipe 20 is depressed.

The preferred outer surface 66 abuts the perimeter of the opaque end surface 62 and is roughened or textured to enhance dispersion of light entering into the light pipe 20 through the rear section 60. With reference to FIG. 6, the coherent light ray A which, under normal circumstances, would pass through and exit the light pipe 20, as shown with the dashed line, is instead dispersed into the light pipe 20 because the outer surface 66 has been roughened. Preferably, the outer surface 66 is roughened by sand blasting immediately after the light pipe 20 is formed, thus streamlining the process by which the light pipes 20 are manufactured for assembly into the picture toy 10. Alternatively, a texture may be applied to the opaque end surface 62 when the light pipe 20 is molded.

It has been found that coating the end of the light pipe 20 with opaque white paint to form the opaque end surface 62 further increases the amount of light which ultimately propagates through the light pipe 20. In summary, the combination of a roughened outer surface 66 and an opaque end surface 62 comprised of opaque white paint increases the light piping efficiency of each light pipe 20, thereby creating brighter illuminated indicia.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A picture toy for creating illuminated indicia by selectively depressing a plurality of light pipes:

a housing;

a first opaque plate attached to the housing, the first opaque plate including a back surface and a first array of apertures;

a second opaque plate attached to the housing, the second opaque plate including a second array of apertures, the second opaque plate being positioned over the first opaque plate and the housing such that light can enter the picture toy only through the apertures of the first and second arrays and such that each aperture of the first array is axially aligned with a corresponding aperture of the second array;

a source of light attached to the housing and facing the back surface of the first opaque plate; and a plurality of light pipes supported by the first and second opaque plates, each light pipe including a rear section slidably fitted into one of the apertures of the first array and a front section slidably fitted into the corresponding aperture of the second array, each light pipe including a central section joining the rear and front sections, the rear section of each light pipe including an opaque end surface which substantially prevents light from entering the light pipe through the rear section when the light pipe is slid into a raised position with the opaque end surface being substantially contiguous with the first opaque plate and, when the light pipe is slid into a depressed position with the rear section protruding from the picture toy through the first aperture, light being allowed to enter the light pipe through the rear section for creating illuminated indicia by selectively depressing a selected plurality of light pipes, the rear section of each light pipe being characterized by a rear section diameter increasing toward the central section, the front section of each light pipe being characterized by a front section diameter increasing toward the central section, the rear section frictionally fitting within one of the apertures of the first array when the light pipe is slid into the depressed position, and the front section frictionally fitting within one of the apertures of the second array when the light pipe is slid into the raised position, each light pipe additionally including a ridge attached to the central portion of the light pipe for preventing each of the plurality of light pipes from sliding beyond a range of positions spanning between the raised position and the depressed position.

2. The picture toy of claim 1 wherein the rear section of each light pipe includes an outer surface which is roughened to enhance dispersion of light entering into the light pipe through the rear section.

3. The picture toy of claim 1 wherein the plurality of light pipes are made from lucite.

4. The picture toy of claim 1 wherein the plurality of light pipes are made from polystyrene.

5. The picture toy of claim 1 wherein the ridge is circumferentially formed around the central section of the light pipe.

6. An apparatus for creating illuminated indicia by selectively depressing a plurality of light pipes:

a housing;

a first opaque plate attached to the housing, the first opaque plate including a back surface and a first array of apertures;

a second opaque plate attached to the housing, the second opaque plate including a second array of apertures, the second opaque plate being positioned over the first opaque plate and the housing such that light can enter the apparatus only through the apertures of the first and second arrays and such that each aperture of the first array is axially aligned with a corresponding aperture of the second array;

a source of light facing the back surface of the first opaque plate; and a plurality of light pipes supported by the first and second opaque plates, each light pipe including a rear section slidably fitted into one of the apertures of the first array and a front section slidably fitted into the corresponding aperture of the second array, each light pipe including a central section joining the rear and front sections, the rear section of each light pipe including an opaque end surface which substantially prevents light from entering the light pipe through the rear section when the light pipe is slid into a raised position with the opaque end surface being substantially contiguous with the first opaque plate and, when the light pipe is slid into a depressed position with the rear section protruding from the picture toy through the first aperture, light being allowed to enter the light pipe through the rear section thereby creating illuminated indicia by selectively depressing a selected plurality of light pipes, the rear section of each light pipe being characterized by a rear section diameter increasing toward the central section, the front section of each light pipe being characterized by a front section diameter increasing toward the central section, the rear section frictionally fitting within one of the apertures of the first array when the light pipe is slid into the depressed position, and the front section frictionally fitting within one of the apertures of the second array when the light pipe is slid into the raised position, each light pipe additionally including a member on the central portion of the light pipe thereby preventing the light pipes from sliding beyond a range of positions spanning between the raised position and the depressed position.

7. The apparatus of claim 6 wherein the rear section of each light pipe includes an outer surface which is roughened to enhance dispersion of light entering into the light pipe through the rear section.

8. The apparatus of claim 6 wherein the plurality of light pipes are made from lucite.

9. The apparatus of claim 6 wherein the plurality of light pipes are made from polystyrene.

* * * * *